US009616497B2

(12) United States Patent
Manchiraju et al.

(10) Patent No.: US 9,616,497 B2
(45) Date of Patent: Apr. 11, 2017

(54) PROVIDING PLASTIC ZONE EXTRUSION

(71) Applicant: Southwire Company, Carrollton, GA (US)

(72) Inventors: Venkata Kiran Manchiraju, Villa Rica, GA (US); Zhili Feng, Knoxville, TN (US); Stan A. David, Knoxville, TN (US); Zhenzhen Yu, Knoxville, TN (US)

( * ) Notice: Subject to any disclaimer, the term of this patent is extended or adjusted under 35 U.S.C. 154(b) by 485 days.

(21) Appl. No.: 13/832,255

(22) Filed: Mar. 15, 2013

(65) Prior Publication Data

US 2013/0266467 A1 Oct. 10, 2013

Related U.S. Application Data

(63) Continuation-in-part of application No. 13/178,746, filed on Jul. 8, 2011.

(Continued)

(51) Int. Cl.
*B21C 23/00* (2006.01)
*B22F 3/20* (2006.01)

(Continued)

(52) U.S. Cl.
CPC ..... *B22F 3/003* (2013.01); *B21C 23/002* (2013.01); *B21C 23/01* (2013.01); *B22F 3/20* (2013.01);

(Continued)

(58) Field of Classification Search
CPC ..... B21C 23/002; B21C 23/01; B21C 23/04; B21C 23/08; B21C 23/218; B21C 25/00; B21C 26/00; C04B 14/00; C04B 20/00; C04B 14/026; C04B 14/10; C04B 14/324; C04B 14/34; C04B 14/386; C04B 2235/3217; C04B 2235/3463; C04B 2235/349; C04B 2235/3826;

(Continued)

(56) References Cited

U.S. PATENT DOCUMENTS 4,041,595 A 8/1977 Voorhes
4,117,703 A * 10/1978 Takahashi ..... B21C 23/002 29/403.2

(Continued)

FOREIGN PATENT DOCUMENTS

CN 1641055 A 7/2005
CN 1869262 A 11/2006

(Continued)

OTHER PUBLICATIONS

Chinese Second Office Action dated Dec. 9, 2014 in Application No. 201110190661.1, 16 pgs.

(Continued)

*Primary Examiner* — David Bryant
*Assistant Examiner* — Lawrence Averick
(74) *Attorney, Agent, or Firm* — Merchant & Gould P.C.

(57) ABSTRACT

Plastic zone extrusion may be provided. First, a compressor may generate frictional heat in stock to place the stock in a plastic zone of the stock. Then, a conveyer may receive the stock in its plastic zone from the compressor and transport the stock in its plastic zone from the compressor. Next, a die may receive the stock in its plastic zone from the conveyer and extrude the stock to form a wire.

10 Claims, 11 Drawing Sheets

Related U.S. Application Data

(60) Provisional application No. 61/362,726, filed on Jul. 9, 2010.

(51) Int. Cl.
*B22F 3/00* (2006.01)
*B21C 23/01* (2006.01)
*B22F 5/12* (2006.01)

(52) U.S. Cl.
CPC ..... *B22F 5/12* (2013.01); *B22F 2998/10* (2013.01); *B22F 2999/00* (2013.01)

(58) Field of Classification Search
CPC ..... C04B 2235/407; C04B 2235/5288; B22F 3/003; B22F 3/20; B22F 2999/00; B22F 5/12; B22F 2998/10; B22F 1/0025; B22F 1/0018
See application file for complete search history.

(56) References Cited

U.S. PATENT DOCUMENTS

| | | | | |
|---|---|---|---|---|
| 5,015,438 | A | 5/1991 | Ashok et al. | |
| 5,284,428 | A | 2/1994 | Sinha et al. | |
| 5,464,340 | A * | 11/1995 | Yano | B21C 23/002 425/382.3 |
| 6,857,555 | B2 * | 2/2005 | Ishida | B23K 20/123 228/112.1 |
| 7,311,135 | B1 | 12/2007 | Suganuma et al. | |
| 2001/0004989 | A1 | 6/2001 | Ezumi et al. | |
| 2004/0141872 | A1 * | 7/2004 | Tsai | B22F 1/0014 419/66 |
| 2006/0208032 | A1 * | 9/2006 | Jones | B23K 20/1215 228/101 |
| 2007/0241164 | A1 | 10/2007 | Barnes et al. | |
| 2008/0041921 | A1 | 2/2008 | Creehan et al. | |
| 2008/0264594 | A1 * | 10/2008 | Lohmueller | B21C 23/005 164/97 |
| 2009/0258232 | A1 | 10/2009 | Brice | |
| 2012/0006086 | A1 | 1/2012 | Manchiraju et al. | |

FOREIGN PATENT DOCUMENTS

| | | | |
|---|---|---|---|
| DE | 102005052470 | B3 | 3/2007 |
| EP | 0363667 | A2 | 4/1990 |
| EP | 1 162 283 | A2 | 12/2001 |
| EP | 1321199 | A2 | 6/2003 |
| EP | 2 404 682 | A1 | 1/2012 |
| GB | 2083770 | A | 3/1982 |
| GB | 2306366 | A | 5/1997 |
| GB | 2364946 | A | 2/2002 |
| JP | 2003181430 | | 7/2003 |
| JP | 2003181431 | | 7/2003 |
| JP | 2009107019 | | 5/2009 |
| JP | 2010090418 | A | 4/2010 |
| WO | WO 99/58288 | | 11/1999 |
| WO | 2008063076 | A1 | 5/2008 |

OTHER PUBLICATIONS

W. T. Choate and J. A. S. Green, (2003). "*U.S. Energy Requirements for Aluminum Production, Historical Perspective, Theoretical Limits and New Opportunities*," BCS, Inc. Columbia, Maryland. Website: http://www.eere.energy.gov/industry/aluminum/pdfs/al)_theoretical.pdf. 150 pgs. (documents NPL1a & NPL1b).

R. J. Fruehan et al., (2000). "Theoretical Minimum Energies to Produce Steel for Selected Conditions," Energetics Inc. Website: http://www.eere.energy.gov/industry/steel/pdfs/theoretical_minimum_energies.pdf. 43 pgs.

Extended European Search Report dated Nov. 15, 2011 in Application No. 11173052.9, 10 pgs.

U.S. Office Action dated Jul. 16, 2015 in U.S. Appl. No. 13/178,746, 18 pgs.

Chinese First Office Action dated Jul. 11, 2014 in Application No. 201110190661.1, 22 pgs.

Extended European Search Report dated Aug. 7, 2014 in Application No. 14160001.5, 10 pgs.

U.S. Office Action dated Aug. 14, 2014 in U.S. Appl. No. 13/178,746, 13 pgs.

U.S. Final Office Action dated Mar. 12, 2015 in U.S. Appl. No. 13/178,746, 25 pgs.

U.S. Office Action dated May 18, 2016 in U.S. Appl. No. 13/178,746, 18 pgs.

U.S. Final Office Action dated Jan. 25, 2016 in U.S. Appl. No. 13/178,746, 19 pgs.

JP 2010090418 A—computer English translation.

Chinese First Office Action dated Feb. 4, 2017 cited in Application No. 201410099126.9, 14 pgs.

* cited by examiner

| Material | Energy type | Theoretical Minimum Energy for New Technology | | | Average Actual Energy Useage | | |
|---|---|---|---|---|---|---|---|
| | | New Technology | Current Technology | Energy Saving | New Technology | Current Technology | Energy Saving |
| Aluminum | Electricity (billion kWh) | 0.106 | 0.71 | | 0.212 | 0.37 | |
| | Natural Gas (trillion Btu) | | | | | 6.34 | |
| | Petroleum - Distillate Fuel (trillion Btu) | | | | | 3.55 | |
| | Coal (trillion Btu) | | | | | 0.06 | |
| | Total (billion Btu) | 0.361 | 2.42 | 85% | 0.722 | 11.2 | 94% |
| Steel | Electricity (billion kWh) | 0.159 | 0.322 | | 0.318 | 0.77 | |
| | Natural Gas (trillion Btu) | | | | | 2.00 | |
| | Petroleum - Distillate Fuel (trillion Btu) | | | | | | |
| | Coal (trillion Btu) | | | | | 0.51 | |
| | Total (billion Btu) | 0.543 | 1.10 | 51% | 1.086 | 5.14 | 79% |

• Note: 1kWh = 3412 Btu for conversion in the table.

FIG. 10

PROVIDING PLASTIC ZONE EXTRUSION

CROSS REFERENCE TO RELATED APPLICATIONS

The present application is a continuation-in-part and claims priority to U.S. application Ser. No. 13/178,746 filed on Jul. 8, 2011. U.S. application Ser. No. 13/178,746 filed on Jul. 8, 2011 claimed priority to and incorporated by reference U.S. Provisional Application No. 61/362,726 filed on Jul. 9, 2010. Both U.S. application Ser. No. 13/178,746 filed on Jul. 8, 2011 and U.S. Provisional Application No. 61/362,726 filed on Jul. 9, 2010 are hereby incorporated by reference in their entirety.

STATEMENT REGARDING FEDERALLY SPONSORED RESEARCH

This invention was made under CRADA No. NFE-11-03251 between Southwire Company and UT-Battelle, LLC operating and management Contractor for the Oak Ridge National Laboratory for the United States Department of Energy. The Government has certain rights in this invention.

COPYRIGHTS

All rights, including copyrights, in the material included herein are vested in and the property of the Applicant. The Applicant retains and reserves all rights in the material included herein, and grants permission to reproduce the material only in connection with reproduction of the granted patent and for no other purpose.

BACKGROUND

Extrusion is a process used to create objects of a fixed cross-sectional profile. A material is pushed or drawn through a die of a desired cross-section. Because a material only encounters compressive and shear stresses, extrusion provides the ability to create objects having complex cross-sections.

SUMMARY

This Summary is provided to introduce a selection of concepts in a simplified form that are further described below in the Detailed Description. This Summary is not intended to identify key features or essential features of the claimed subject matter. Nor is this Summary intended to be used to limit the claimed subject matter's scope.

Plastic zone extrusion may be provided. First, a compressor may generate frictional heat in stock to place the stock in a plastic zone of the stock. Then, a conveyer may receive the stock in its plastic zone from the compressor and transport the stock in its plastic zone from the compressor. Next, a die may receive the stock in its plastic zone from the conveyer and extrude the stock to form a wire.

Both the foregoing general description and the following detailed description provide examples and are explanatory only. Accordingly, the foregoing general description and the following detailed description should not be considered to be restrictive. Further, features or variations may be provided in addition to those set forth herein. For example, embodiments may be directed to various feature combinations and sub-combinations described in the detailed description.

BRIEF DESCRIPTION OF THE DRAWINGS

The accompanying drawings, which are incorporated in and constitute a part of this disclosure, illustrate various embodiments of the present invention. In the drawings:

FIG. 10 shows energy consumption for producing one million metric tons of products;

DETAILED DESCRIPTION

Figure 1:
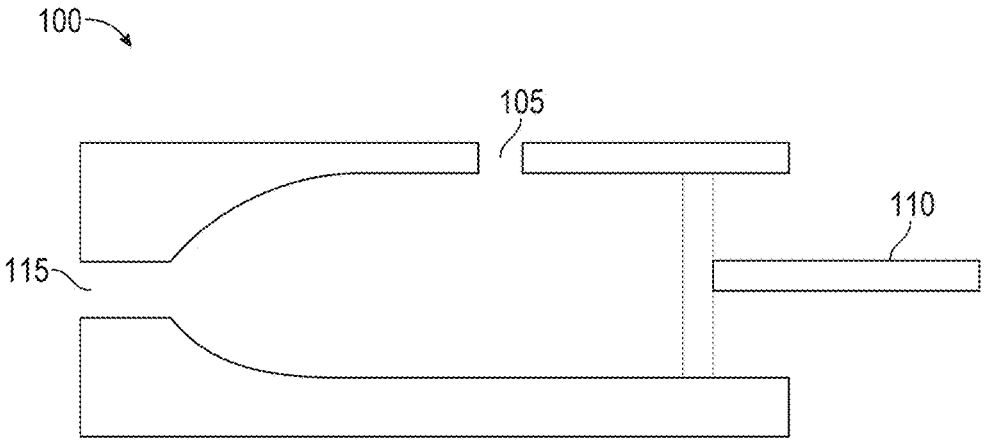
FIG. 1 shows an extrusion system.

The following detailed description refers to the accompanying drawings. Wherever possible, the same reference numbers are used in the drawings and the following description to refer to the same or similar elements. While embodiments of the invention may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the invention.

For the U.S. domestic metal producers (steels, Al alloys, Ti alloys, for example), recycling scraped materials is of prominent importance for a number of reasons. First, there are great concerns on the environmental issues related to disposing the scraped metals as industrial wastes. There is also an issue of diminishing domestic natural mineral resources, in contrast to the abundance and continuing pileups of scraped metals produced over the years of industrialization. The primary driver may be in the economics. It may be far cheaper, faster, and more energy-efficient to recycle than to manufacture from ores. In addition, capital equipment costs may be low for recycling. For example, recycling aluminum may require only about 10% of the capital equipment costs of these for production from ore. Mini steel mills with EAF furnaces that mainly use scraps as feedstock may also be less expensive to construct than the large BOF based integrated mills.

The U.S. Department of Energy's Industrial Technology Program (ITP) conducted a series of studies looking into the energy consumptions in the most energy-intensive industry sectors. For both steel industry and aluminum industry—the two largest metal making industries in the U.S.—converting scraps into usable products have become the major source of production.

Since the 1960's, recycling aluminum scraps in the U.S. has steadily grown, both in terms of the tonnage, and the percentage of total production. In 2000, nearly half (48.5%) of the aluminum metal produced in the U.S. was from recycled material. Similar trend exists in steelmaking. Steel has become the most recycled material, with two-third of U.S. steel now produced from scrap. Over ten million cars are shredded annually and the shredder scrap from these cars is returned to the melt shops.

Melting the feedstock may be a major energy efficiency barrier in metal recycling. In general, melting and melt processing operations may be the most energy intense of all post-smelting processes. Thermal energy may be used to heat the scrap from ambient temperature to well above the melting point. A considerable portion of the thermal energy may be consumed to overcome the latent heat of fusion associated with melting. The thermal efficiency of today's melting process may be also low. For steel, the best-practice energy usage of EAF steelmaking using 100% scrap charge is about 6.7 MBtu/cast ton, about five times of the theoretical minimum energy. For aluminum, the ratio is 2.50 kWh/kg to 0.33 kWh/kg—the actual usage is about 7.6 times of the theoretical minimum value.

Recycling of scrap materials has become a major source and will play an even more important role in future production and manufacturing of industrial metals in the U.S. The shift to a recycling dominant metal-making market represents a fundamental change in the feedstock materials in the US. This shift also presents a window-of-opportunity to re-think how metals should be produced from recyclables with even greater energy efficiency, environmental benefits, and product quality.

FIG. 1 shows a plastic zone extrusion system 100 consistent with embodiments of the invention for providing plastic zone extrusion. As shown in FIG. 1, plastic zone extrusion system 100 may include an inlet 105, a plunger 110, and an orifice 115. Consistent with embodiments on the invention, stock may be placed in inlet 105. Once plastic zone extrusion system 100 receives the stock, plunger 110 may compress the stock and force (e.g., extrude) the stock through orifice 115 in the form of a wire. For example, plunger 110 may turn the stock thus generating frictional heat. The generated frictional heat may heat the stock to a "plastic zone" of the stock. The plastic zone may comprise a solid state in which the stock is malleable, but not hot enough to be in a liquid or molten state. In other words, plastic zone extrusion system 100 may include a rotating die configured to generate heat by rotating the stock within plastic zone extrusion system 100. Once the generated heat places the stock in the stock's plastic zone, the stock may be extruded out orifice 115. The process may be continuously repeated by continuously adding stock into inlet 105 and continuously extruding wire out orifice 115 to construct a wire of any length.

The stock may comprise any material that may be placed in the stock's plastic zone by plastic zone extrusion system 100. For example, the stock may comprise aluminum, copper, or a combination. The stock, for example, may comprise shavings or swarf. Swarf may comprise metal shavings or chippings, for example, debris or waste resulting from metalworking operations. Swarf may be recycled, for example, due to the environmental concerns regarding potential contamination with liquids such as cutting fluid or tramp oil. These liquids may be separated from the metal using a centrifuge, thus allowing both to be reclaimed and prepared for further treatment.

Moreover, consistent with embodiments of the invention, the stock may comprise one metal, a plurality of any metals, or a combination of a metal or metals with another non-metal substance or substances. For example, the stock may comprise both copper and aluminum. With conventional systems, there may be a limit to the amount of molten copper that can mix homogeneously with molten aluminum. Consistent with embodiments of the present invention, the stock may include copper and aluminum in any percentage. Consequently, a wire may be constructed balancing aluminum's strength and light weigh with copper's conductivity. In other words, copper may be added to aluminum stock to increase the stocks conductivity.

The stock may also comprise any recycled or recyclable substance such as shredded aluminum cans. With conventional systems, recycled material, such as aluminum cans, must go through a "de-lacquering" process to remove substances from the recycled material. Consistent with embodiments of the invention, wire may be constructed using shredded aluminum cans that have not been de-lacquered thus avoiding costs associated with de-lacquering. While such wire may not have as high conductivity as stock that has been de-lacquered, this wire may be used in situations in which this is not an issue (e.g. fence wire).

Furthermore, consistent with embodiments of the invention, nano-particles may be added to the stock. For example, nano-particles of aluminum oxide may be added to aluminum stock to increase strength and conductivity of wire made with this stock. Notwithstanding, added nano-particles may add to the strength, conductivity, thermal expansion, or any physical or chemical property of wire made from stock with nano-particles added. With conventional systems, because material used to make wire has to be heated at least until it melts, any nano-particles added in conventional systems my not be stable (e.g. may lose their desired properties) at the temperature of molten metals.

A highly energy-efficient solid-state material synthesis process—a direct solid-state metal conversion (DSSMC) technology may be provided. Specifically, nano-particle dispersion strengthened bulk materials may be provided. Nano-composite materials from powders, chips, or other recyclable feedstock metals or scraps through mechanical alloying and thermo-mechanical processing may be provided in a single-step. Producing nano-engineered bulk materials with unique functional properties (e.g. thermal or electrical) may also be provided. Nano-engineered wires may be used in long-distance electric power delivery infrastructure.

Embodiments of the present invention may comprise a DSSMC system and method. These systems and methods may eliminate the need of melting (the most energy extensive step) during scrap-to-metal conversion/recycling process, thereby reducing the energy consumption and the cost of the metal making. Furthermore, since melting and solidification may be avoided, embodiments of the invention may open new pathways toward producing new classes of materials such as nano-engineered structural and functional materials by using, for example, mechanical alloying and processing. Embodiments of the present invention may use friction extrusion of metal recycling and friction stir processing of nano-particle strengthened surfaces.

Friction Extrusion

Figure 2A:
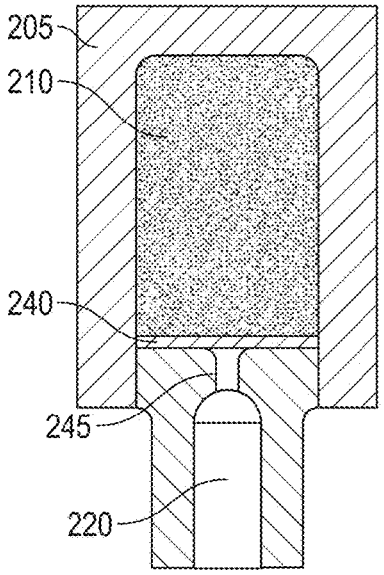
FIG. 2 shows a friction extrusion system.
Figure 2B:
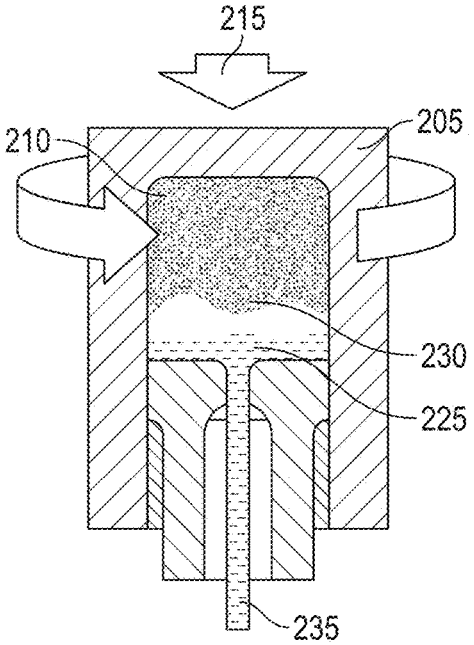

Friction extrusion may be a direct solid-state metal conversion process. Friction extrusion is shown in FIG. 2. A rotating chamber 205 filled with swarf 210 (e.g., machining chips or metallic powder) may be applied under axial load 215 onto a plunger 220 and extruded. Located between plunger 220 and swarf 210 may be a fusible plug 240. In addition, plunger 220 may include an orifice or die 245. The frictional heat and pressure caused by the relative motion and the initial restriction in the axial extrusion flow allow a plasticized layer 225 to form without the need for an external heat source. Considerable heat is generated by the high-strain rate plastic deformation in this layer that softens the material for mixing and consolidation. A relatively localized heat affected transition zone 230 may separate the plasticized layer from the compressed swaft 210 that may remain stagnant within chamber 205. With continued generation of plasticized layer 225 and progressive consumption of the swarf 210, a solid rod 235 may be hydrostatically extruded through die 245. From the energy consumption point of view, because considerable temperature rise may be restricted to thin plasticized layer 225, heat loss to the environment may be considerably lower than the heat loss of a heating furnace.

Figure 3:
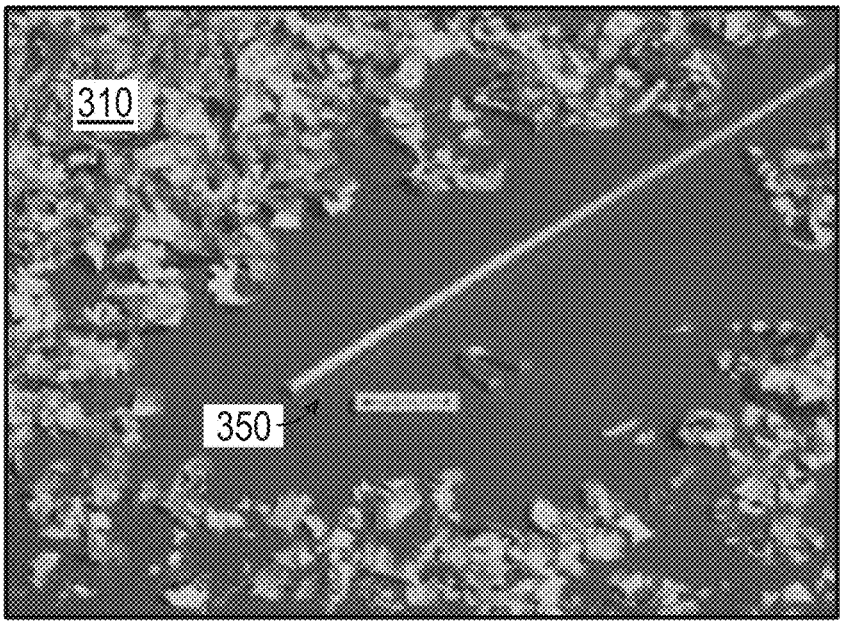
FIG. 3 shows a wire produced from machining chips.

As shown in FIG. 3, a solid Al—Mg alloy wire 305 of over 3 mm in diameter and several meters long may be produced from, for example, machining chips 310. Good mechanical properties and greater than 99.8% densification (as measurement by density) may be achieved. Simple hand bend tests through 180° and tensile tests may demonstrate the integrity of the finished rod. Tensile test may achieve 130 MPa.

Figure 4:
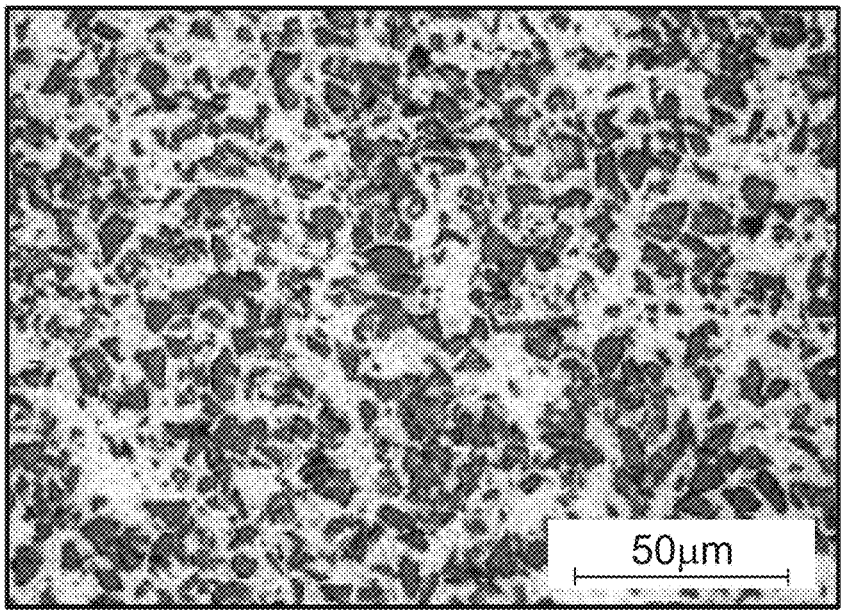
FIG. 4 shows a dispersed discontinuous SiC particulate in aluminum 2618 alloy matrix.

Consistent with embodiments of the invention, the extensive thermo-mechanical deformation may be to produce mechanically alloyed materials. Aluminum powder 2618 and 40% micron-sized silicon carbides may be used as the feedstock. Consistent with embodiments of the invention, most processed materials may be produced with reasonable appearance, consequently at least partial consolidation and conversion of the feedstock materials may be achieved. FIG. 4 shows the longitudinal section of a metal matrix composite bar made in trial runs. The dispersed discontinuous SiC particulates may be uniformed distributed in the aluminum 2618 alloy matrix.

Consistent with embodiments of the invention, the product from the friction extrusion may be a round wire/bar. However, other forms or shapes of products could be made through use of different die and plunger designs. Also, there may be no barrier limiting the size of the final products, if the process consistent with embodiments of the invention is scale up, for example, through additional hot extrusion/forming/rolling of the billet produced from multiple friction extrusion stations.

Friction Stir Processing

Figure 5A:
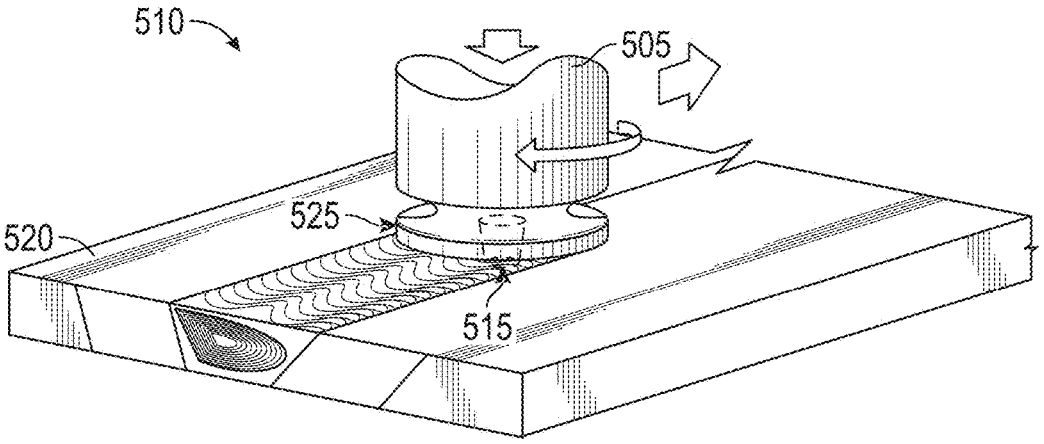
FIG. 5 show a friction stir process.
Figure 5B:
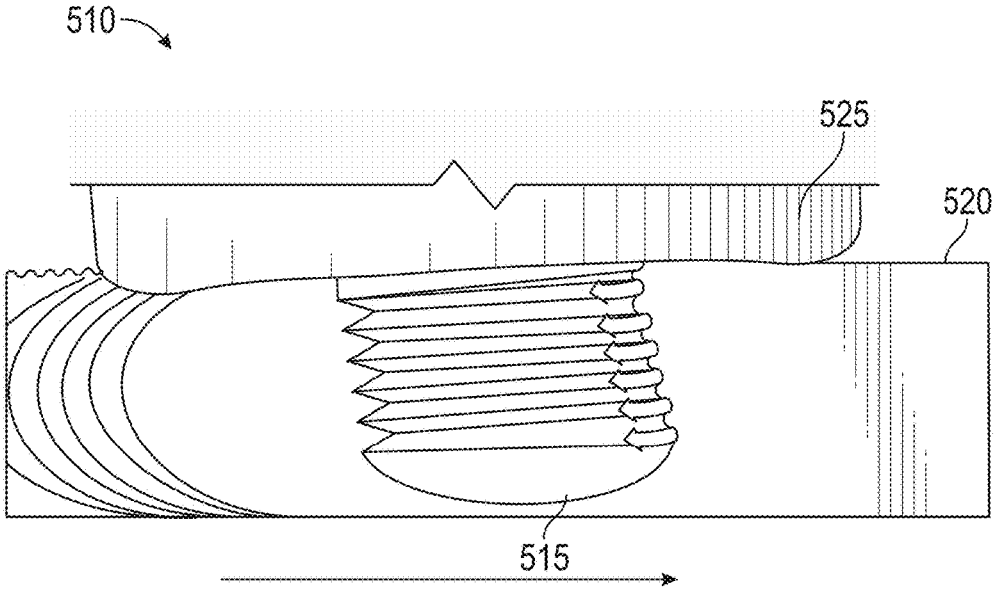

Consistent with embodiments of the invention, friction stir processing (FSP) may incorporate nano-sized oxide particles into Al matrix to form a mechanically alloyed hard and strong nanocomposite surface layer. FSP may comprise a variant of friction stir welding. In FSP (e.g., FIG. 5), a rotating tool 505 may be pushed against a workpiece 510 being processed such that a pin 515 of rotating tool 505 is buried in workpiece 510 and tool shoulder 525 is in full contact with a surface 520 of the workpiece. During processing, the temperature in a column of workpiece material under a tool shoulder 525 may be increased substantially, but below the melting point of the material, largely due to the frictional heating and high-strain rate deformation at the interface of the rotating tool 505 and workpiece 510. The increase in temperature may soften the material and allow the rotating tool 505 to mechanically stir the softened material toward the backside of pin 515 for consolidation and mechanical alloying. The high straining rate and the extensive material flow/deformation of FSP, which are not easily achievable in other thermo-mechanical deformation processes, may result in microstructures with unique or drastically improved properties.

Figure 6:
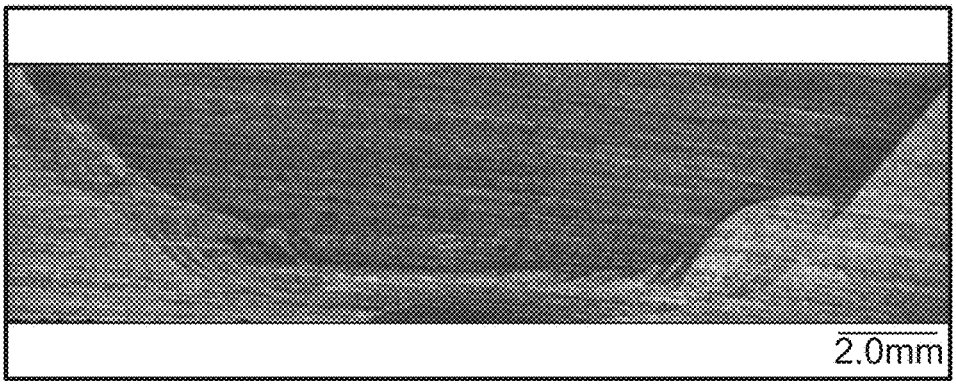
FIG. 6 shows a cross-section view of FSP zone.

Consistent with embodiments of the invention, up to 20% volume fraction of nano-sized $Al_2O_3$ particles may be uniformly dispersed and mechanically alloyed with the Al matrix to form a nano-composite material with greatly increased strength. The Al—$Al_2O_3$ nano-composite may have over an order of magnitude higher compressive strength than that of baseline comparison metal. The wear resistance may be several orders of magnitude higher. FIG. 6 shows the cross-section of the friction stir processed Al—$Al_2O_3$ nano-composite surface layer, and the resulting uniform distribution of the nano oxide particles. FSP may have a surface modification technology not intended for bulk nano-material production. Consistent with embodiments of the invention, a high volume fraction of nano particles may be uniformly incorporated into bulk metal matrix by extensive thermo-mechanical deformation and mixing from friction stir action.

Figure 7:
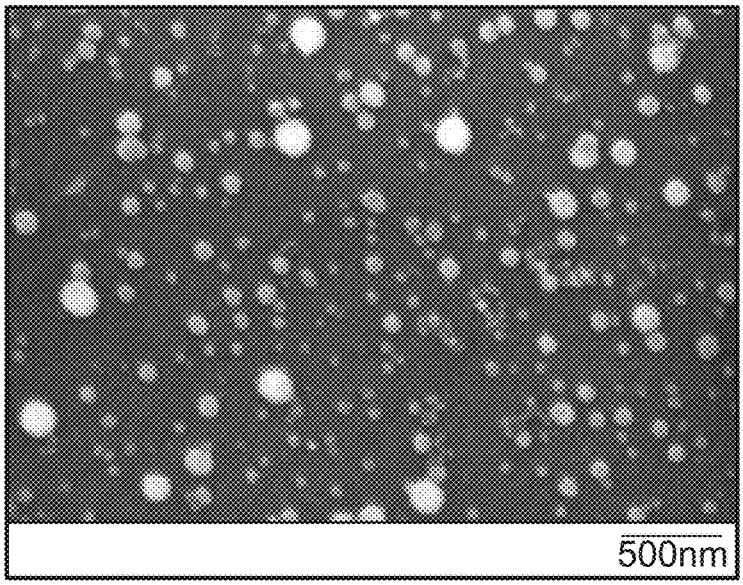
FIG. 7 shows a uniform dispersion of nano $Al_2O_3$ particles in a pure Al matrix by FSP.

FIG. 7 shows a uniform dispersion of nano $Al_2O_3$ particles in pure Al matrix by FSP. The initial oxide particle size in FIG. 7 is approximately 50 nm.

Embodiments of the invention may provide a direct solid-state metal conversion process that includes: (1) metal recycling with greatly improved energy efficiency; and (2) synthesis of nano-engineered bulk materials with enhanced mechanical strength and other unique functional properties.

DSSMC consistent with embodiments of the invention may provide high energy efficiency including an over 80% energy reductions in DSSMC over conventional metal conversion/synthesis processes that involve metal melting. Actual energy savings in production could be even higher, due to, for example, the energy efficiency of the mechanical system over the thermal/melting system. DSSMC may be environmentally friendly due to recycling scraps and low energy consumption.

Since melting and solidification may be eliminated, DSSMC may be suitable for synthesis of high-performance structural materials and functional materials that relies on mechanical alloying principles. DSSMC may produce lightweight metal matrix composites for transportation systems, nano-engineered (nano-composite, and/or nano-crystalline) bulk materials for electricity infrastructure, and oxide dispersion strengthened (ODS) alloys for nuclear energy systems. It may also be used in the low-cost Ti process, as well as Ti based composite materials such as TiAl intermetallics and/or SiC-reinforced Ti alloys.

DSSMC may be a continuous process that may be much easier to scale-up for high-volume production of bulk nano-engineered materials, in comparison with the powder metallurgic (PM)+ hot isostatic pressing (HIP) and other mechanically alloying or nano material synthesis processes.

- DSSMC may not be limited to wires or rods. Other shapes may be produced with proper design of the die and related process conditions.
- DSSMC may be deployed as a metal recycling process with much lower energy consumption, operational cost and equipment cost.
- The relevance and significance of DSSMC as a bulk nano-material synthesis technology is discussed further below.

Consistent with embodiments of the invention, engineering materials strengthened with nano-sized oxides and other ceramic particulate dispersoids may have some unique properties. For the same volume fraction, nano-sized particles may be much more effective than micron-sized particles in strengthening the material due to reduced inter-particle spacing and the Orowan hardening effect. Because the oxides and ceramic particles may be thermally stable and insoluble in the matrix, dispersion strengthened materials may retain their strength up to temperatures near the matrix melting point. Further, dispersion strengthening may not have the same limitation of precipitation strengthening that requires high solubility of solute atoms at high temperatures and specific nano phase forming thermodynamics and kinetics. Therefore, dispersion strengthening may lessen the compositional restrictions in alloy design—an important aspect in metal recycling as it may ease the requirement for metal sorting.

Dispersion strengthened materials may be produced in small quantity through mechanical-alloying power-metallurgy route that may be involved in HIP and multi-step hot rolling and annealing. Examples may include oxide dispersion strengthened (ODS) ferrous and non-ferrous alloys intended for next generation nuclear reactors and ultra high-temperature boiler applications. However, the PM+HIP process may be highly energy intensive and very costly to scale-up. Nano ceramic dispersion particles may be added to cast Al alloys and Mg alloys with considerable improvement in mechanical properties, especially high-temperature creep strength.

Although casting can produce large quantity of bulk materials, achieving uniform dispersion of nano-sized particles in the molten metal and subsequent solidified metal matrix may be difficult. Due to the low density and the van der Waals force effect, the nano-sized oxide particles may tend to agglomerate and float to the surface during metal casting. Attempts to apply external energy field such as ultrasonic energy to breakdown the agglomerates and mix the nano-particles uniformly in the molten metal have been experimented in laboratory with limited success.

DSSMC consistent with embodiments of the invention may provide an approach to produce nano-engineered materials. Uniform dispersion may be provided with much higher volume fraction (up to 20%) of nano-particles in a metal matrix. Friction extrusion shares the same deformation and metallurgical bonding principles with FSP and other widely used friction based solid-state joining processes. They all may rely on frictional heating and extreme thermo-mechanical process deformation to stir, mix, mechanically alloy, and metallurgically consolidate and synthesize the material together. Friction extrusion may offer a practical means to produce bulk materials utilizing the principle of friction stir consolidation.

Embodiments of the invention may provide:

- Different shaped products.
- Nano-engineered bulk materials (solid wires) via DSSMC.
- Co-recycling different types of Al alloys (such as 5xxx series with 6xxx series).

Although DSSMC may recycle and convert a variety of industrial metals, the analysis in this section will be limited to two type of metals: aluminum alloys and steels for which the widespread applications of the transformational DSSMC technology is expected to have highest energy, economic, environmental impacts. DSSMC may be applied to steel products especially on tool materials used for the dies and the plungers.

The analysis on the energy, economic, and environmental impacts from the application of the DSSMC technology may be divided into two parts. The first part describes the procedure, references and assumptions used in the analysis. The second part summarizes the analysis results.

Figure 8:
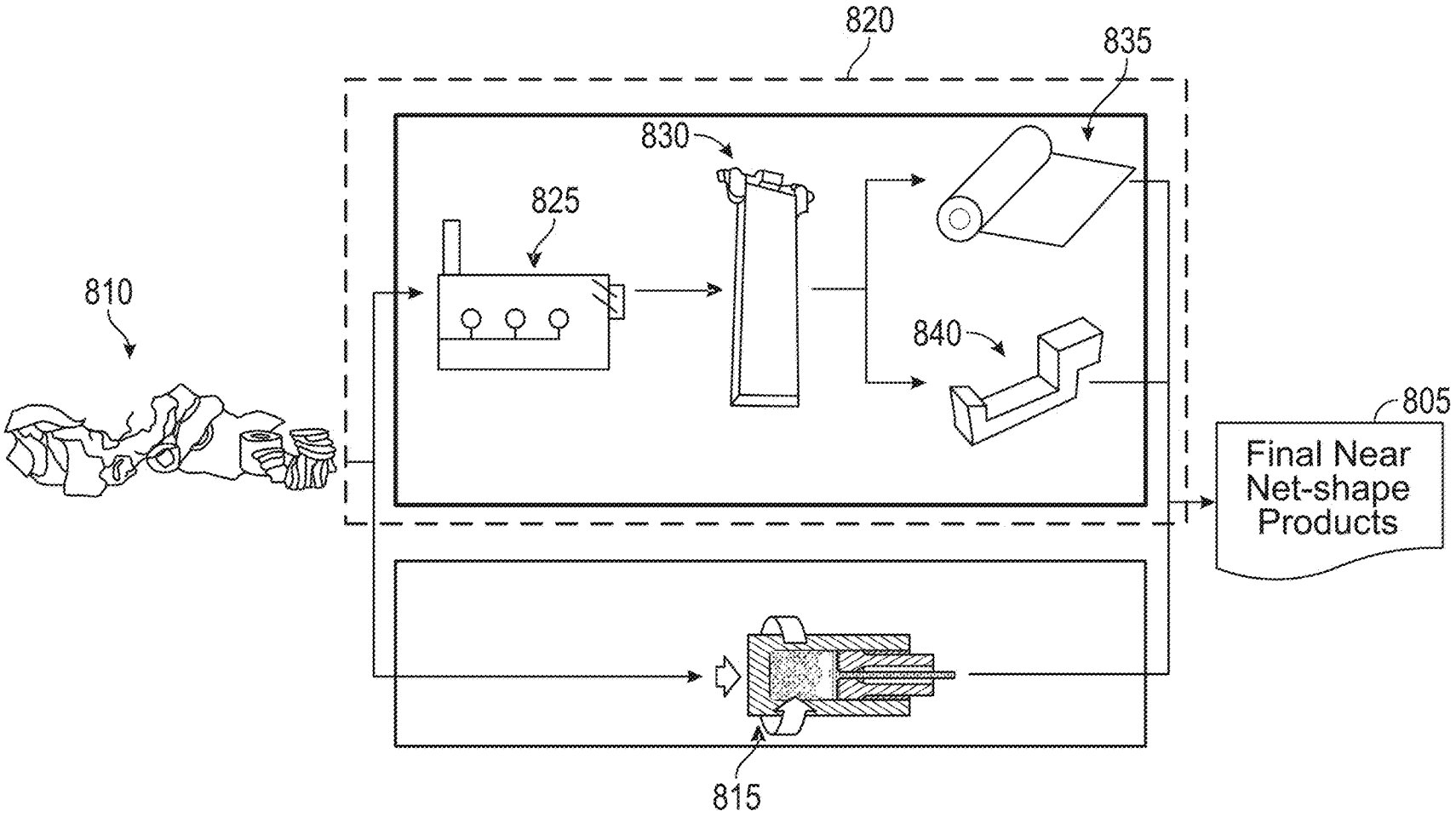
FIG. 8 shows stages involved in making comparable final products from recyclable scraps for embodiments of the invention and the current technology involving melting, casting and rolling/extrusion.

FIG. 8 shows the comparison of the basic operation steps of the current technologies and the new technologies for converting scraps to near net-shape products.

Current Baseline Technology

Secondary aluminum production—aluminum produced entirely from re-cycled aluminum scrap—is an example of as the current baseline technology (e.g. conventional.) Secondary aluminum production may comprise a number of major operations. The scraps are first melted in a furnace, cast into large ingot, billets, T-bar, slab or strip, and finally rolled, extruded or otherwise formed into the components and useful products. The secondary aluminum industry is a large market—currently, over 50% of the domestically produced Al products are made from aluminum scraps.

A mini steel mill may comprise a conventional system for steel production. The mini steel mill may comprise an electric arc furnace, billet continuous caster and rolling mill capable of making long products (bars, rod, sections, etc). The mini steel mill takes 100% scrap charge and makes bar and rod stocks as the final product. Therefore, both the input and output are the same in the direct conversion and the mini-mill steel converting processes.

The DSSMC process consistent with embodiments of the invention may produce near net-shape products from recyclable scraps in a single step, for the products described above by the current baseline technologies.

FIG. 8 shows steps involved in making comparable final products 805 from recyclable scraps 810 for embodiments of the invention 815 and the current technology 820. Current technology 820 may comprise a furnace 825 to melt recyclable scraps 810. The melted recyclable scraps may be cast 830 into ingots. The ingots then may be formed into the final products 805 via rolling 835 or extrusion 840.

Figure 9:
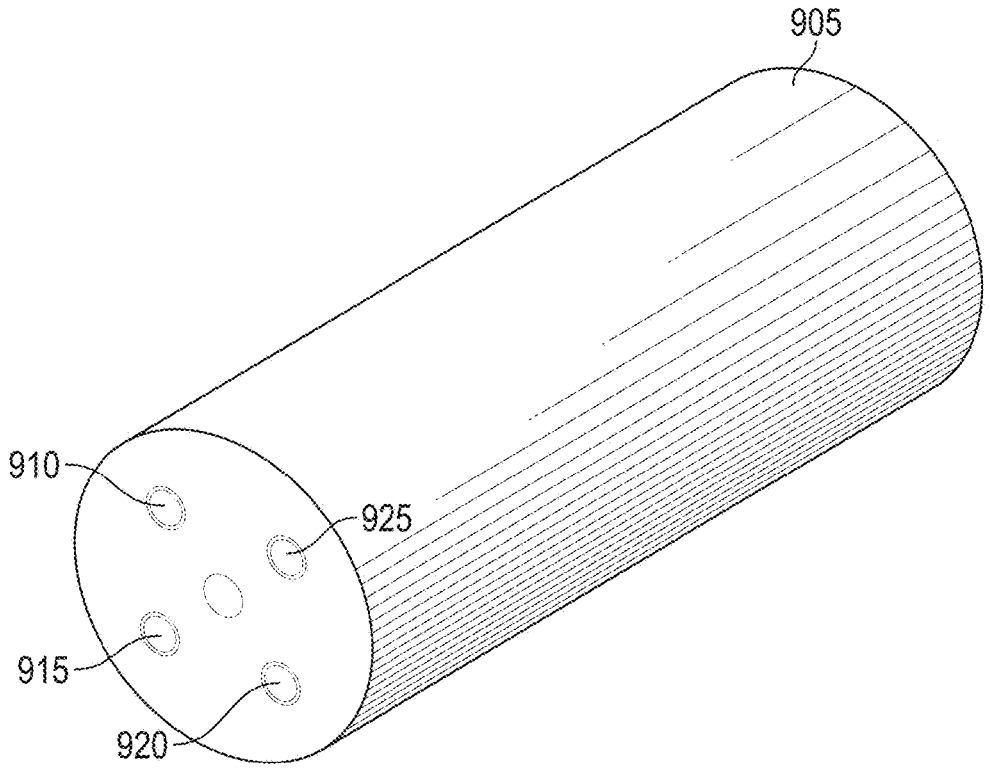
FIG. 9 shows an example of final products manufactured via extrusion processes consistent with embodiments of the invention.

FIG. 9 shows an example of final products 805. Embodiments of the invention may be used to extrude complex objects. For example, FIG. 9 shows a cylindrical bar 905 having a first internal rod 910, a second internal rod 915, a third internal rod 920, and a fourth internal rod 925. During manufacturing, multiple chambers may be filled with swarf and multiple dies may be used to form cylindrical bar 905, first internal rod 910, second internal rod 915, third internal rod 920, and fourth internal rod 925. For instance, a first chamber may be filled with swarf and have a first die capable of extruding first internal rod 910, second internal rod 915, third internal rod 920, and fourth internal rod 925. A second chamber may be filled with swart, either of the same metal/alloy, or a different metal/alloy, and have a second die capable of extruding cylindrical bar 905. Consistent with embodiments of the invention, during a single extrusion both cylindrical bar 905 and first internal rod 910, second internal rod 915, third internal rod 920, and fourth internal rod 925 may be formed.

Operational Example

Analysis Procedure

Energy analysis may comprise two major steps. The first step may comprise determining the unit energy consumption for both the current baseline technology (conventional) and embodiments consistent with the invention. This included determination of the theoretical minimum energy requirements for both current and embodiments consistent with the invention, the actual average energy usage by U.S. industry for the current baseline technology, and the estimated energy usage for embodiments consistent with the invention. To ensure proper energy and environmental calculations, the "process energy"—the energy used at a process facility (the onsite energy)—may be determined. It does not include the energy losses incurred at offsite utilities (such as power generation and transmission loss).

In the second step, appropriate U.S. domestic Al and steel production figures may be obtained from available market survey. The unit energy usage data from the first step, together with the statistic annual production data from the second step, may be used as input to, for example, Energy Savings Calculation Tool (GPRA2004 Excel spreadsheet) from DOE ITP to determine the overall energy, economic and environmental benefits of the new technology.

Unit Energy Consumption Comparison

Energy Usage of Current Baseline (Conventional) Technology

The energy usage of the current baseline technology can be found from DOE reports. In general, a variety of fuels are used in different stages of Al or steel making. Choate and Green's study provides a detailed account of the energy used in aluminum recycling. According to this study, the energy usage for making final near net-shape product is:

$$\frac{\text{Total Energy}}{\text{kg } AL} = \text{Ingot Casting} + \frac{(2.75 * \text{Hot Rolling} + 2.75 * \text{Cold Rolling} + 1.72 * \text{Extrusion})}{6.72}$$

In this equation, it is assumed that percentages of ingots used for rolling and extrusion are proportional to the annual rolling and extrusion production rates: 2.75 million metric tons for hot rolling, 2.75 million metric tons for cold rolling, and 1.72 million metric tons for extrusion. The actual energy consumptions for steel recycling (EAF furnaces in mini steel mills) are estimated in the similar fashion according to the study by Stubbles.

The average actual unit energy consumption figures are presented in Table 1, together with the theoretical minimum energy requirement for both current (conventional) and new technology (embodiments of the invention), and estimated energy usage for embodiments of the present invention. The theoretical minimum energy requirements were obtained from Choate and Green for aluminum, and Fruehan's study for steel.

Energy Usage that May be Used by Embodiments of the Invention

The unit energy consumption of embodiments of the invention, for example, is estimated below. In DSSMC process, friction may be used to drive the localized deformation and heating. Both the frictional heating and high-strain rate plastic deformation result in an increase in temperature of the processed region. Therefore, the energy input can be estimated from the temperature increase in the processing region. The minimum theoretical energy may be determined from adiabatic heating by plastic work:

$$\Delta H = \int_{T_2} C_P dT$$

where $C_p$ is the specific heat capacity of the material processed, and $T_2$ is the processing temperature. The processing temperature is assumed to be 450° C. for aluminum alloys and 1300° C. for steels, based on the typical hot forging temperatures of the materials. The average specific heat is 0.9 and 0.45 respectively for Al and Fe.

The energy efficiency of the new technology is assumed to be 50%. This figure is based on the fact that the new technology is primarily a mechanical deformation process. According to Choate and Green, the efficiency of electrical/hydraulic system for rolling and extrusion is 75%. A lower efficiency may be assumed to account for other uncounted energy loses of the new technology.

Energy Reduction on Unit Product Basis

FIG. 10 shows the comparison of the energy consumption for producing one million metric tons of products using embodiments of the present invention and the current baseline technology. The energy usage was broken down according to the type of fuels used in the current Al and steel making (from 100% scraps), as different types of fuels have different environmental impact (such as CO2 emission). It may be assumed that the DSSMC process is an electric/hydraulic driven mechanical system that uses 100% electricity.

As shown in FIG. 10, the new technology (i.e., embodiments of the present invention) has enormous energy saving potential. The reduction of the theoretical minimum energy usage is 85% and 51%, respectively for Al alloys and steels. Because of the energy inefficiencies of the current (i.e., conventional) technology, the estimated reductions of the actual energy usage are over 90% for aluminum and about 80% for steels. Similar energy savings may be achieved with the solid-state friction stir welding process.

When designing a product (e.g. a wire), it may be desirable for the product to have certain properties. These certain properties may be achieved by making the product of different metal alloys and maybe including a certain type or types of nanoparticles in the product. To achieve these desirable properties, the nanoparticles and/or microstructures of different metal alloys may be substantially homogeneously distributed within the product. These certain properties may include, but are not limited to, strength, conductivity, thermal expansion, malleability, etc.

Consistent with embodiments of the invention, a plastic zone extrusion system may be provided that may extrude stock to form a wire comprising nanoparticles and/or microstructures of a first alloy and a second alloy that may be substantially homogeneously distributed within the wire. If the nanoparticles or alloys were heated to their liquid or molten state, the materials comprising nanoparticles or alloys would stratify into respective layers comprising the nanoparticles or alloys and would not be homogeneously distributed. However, the plastic zone extrusion system, consistent with embodiments of the invention, may take the stock comprising different alloys and or nanoparticles to their "plastic zone" that comprises a solid state in which the stock is malleable, but not hot enough to be in a liquid or molten state. Because the plastic zone extrusion system, consistent with embodiments of the invention, mixes the stock (which may or may not include nanoparticles) while in its plastic zone, any wire extruded from the stock by the plastic zone extrusion system may include nanoparticles and/or microstructures of a first alloy and a second alloy that may be substantially homogeneously distributed within the wire.

Figure 11:
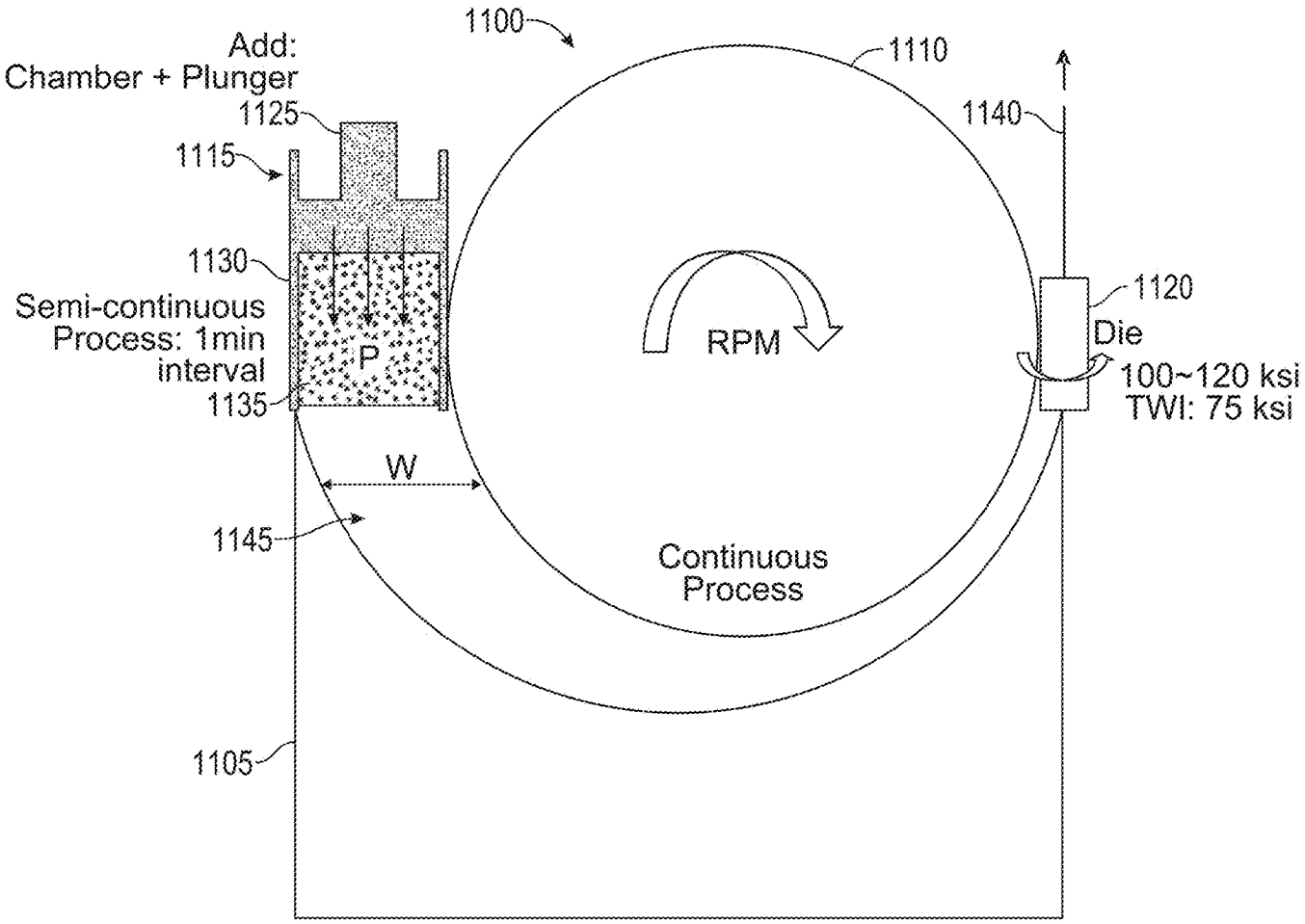
FIG. 11 shows a plastic zone extrusion system.

FIG. 11 shows a plastic zone extrusion system 1100 consistent with embodiments of the invention for providing plastic zone extrusion. As shown in FIG. 11, plastic zone extrusion system 1100 may comprise a conveyer comprising a base 1105 and a wheel 1110. Plastic zone extrusion system 1100 may further comprise a compressor 1115 and a die 1120. Compressor 1115 may comprise a plunger 1125 and a chamber 1130. Compressor 1115 may be configured to generate frictional heat in stock 1135 to place stock 1135 in a plastic zone of stock 1135. Die 1120 may be configured to receive stock 1135 in its plastic zone from the conveyer and extrude stock 1135 to form a wire 1140. Consistent with embodiments of the invention, a space 1145 between wheel 1110 and base 1105 may gradually decrease in size from compressor 1115 to die 1120. In other words, space 1145 may have a width W at the compressor 1115 end of space 1145, but the width of space 1145 may be much smaller than W at the die 1120 end of space 1145.

Consistent with embodiments on the invention, stock 1135 may be placed in compressor 1115. Once compressor 1115 receives stock 1135 into chamber 1130, plunger 1125 may compress stock 1135 and force (e.g., extrude) stock 1135 out the bottom end of chamber 1130. For example, while plunger 1125 is compressing stock 1135, plunger 1125 may also rotate within chamber 1130 thus mixing stock 1135 and generating frictional heat. The generated frictional heat may heat stock 1135 to a "plastic zone" of the stock.

The plastic zone may comprise a solid state in which stock 1135 is malleable, but not hot enough to be in a liquid or molten state. In other words, plastic zone extrusion system 1100 may rotate plunger 1125 to generate heat by rotating, mixing, and compressing stock 1135 within plastic zone extrusion system 1100. Once the generated heat places stock 1135 in the stock's plastic zone, the stock may be extruded out the bottom end of chamber 1130. The process may be continuously repeated by intermittently feeding more stock into compressor 1115. For example, plunger 1125 may be removed, more stock may be placed in chamber 1130, and plunger 1125 may be replaced in chamber 1130.

Once stock 1135, now in its plastic zone, leaves the bottom end of chamber 1130, it enters space 1145. Wheel 1110 may be rotating in a direction (e.g. counter clockwise) that may force stock 1135 away from the bottom end of chamber 1130 and towards die 1120. Because space 1145 between wheel 1110 and base 1105 may gradually decrease in size from compressor 1115 to die 1120, the movement of wheel 1110 may also compress (e.g. compact) and mix stock 1135.

Furthermore, because space 1145 between wheel 1110 and base 1105 may gradually decrease in size from compressor 1115 to die 1120, there may be more volume in space 1145 at the end closest to compressor 1115 than at the end closest to die 1120. Consequently, the end of space 1145 closest to compressor 1115 may act as a reservoir for stock 1135 allowing time for intermittently feeding more stock into compressor 1115 (e.g. continuously repeated by, for example, removing plunger 1125, placing more stock in chamber, and replacing plunger in chamber 1130.)

Consistent with other embodiments of the invention, compressor 1115 may be optional and the conveyer may be configured to generate frictional heat in stock 1135 to place stock 1135 in the plastic zone of stock 1135. Moreover, plastic zone may be achieved by die 1120, for example, by die 1120 rotating.

Figure 12:
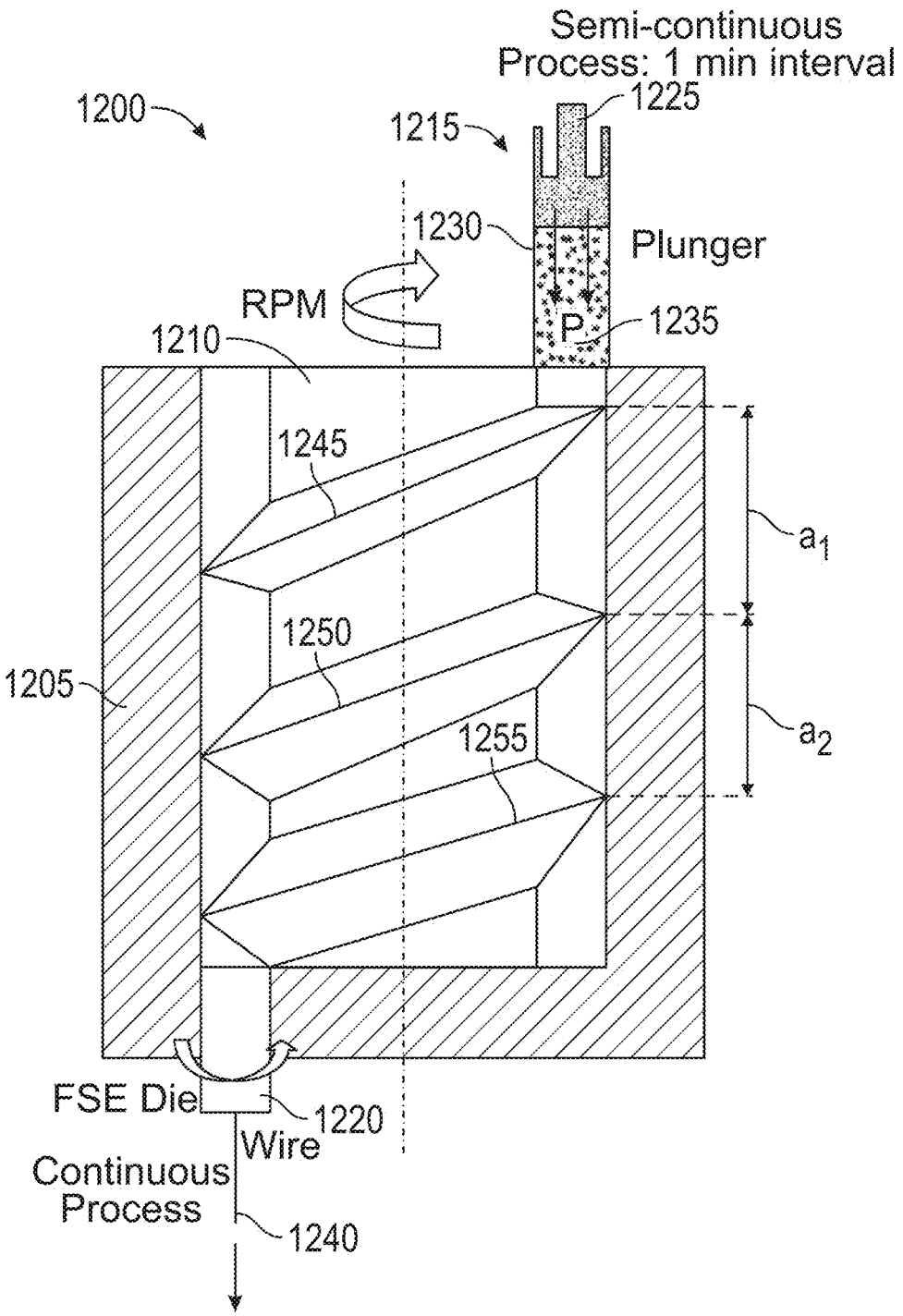
FIG. 12 shows a plastic zone extrusion system.

FIG. 12 shows a plastic zone extrusion system 1200 consistent with embodiments of the invention for providing plastic zone extrusion. As shown in FIG. 12, plastic zone extrusion system 1200 may comprise a conveyer comprising a base 1205 and a screw 1210 (e.g. a varying pitch screw.) Plastic zone extrusion system 1200 may further comprise a compressor 1215 and a die 1220. Compressor 1215 may comprise a plunger 1225 and a chamber 1230. Compressor 1215 may be configured to generate frictional heat in stock 1235 to place stock 1235 in a plastic zone of stock 1235. Die 1220 may be configured to receive stock 1235 in its plastic zone from the conveyer and extrude stock 1235 to form a wire 1240. Screw 1210 may include a plurality of threads (e.g. a first thread 1245, a second thread 1250, and a third thread 1255.) Consistent with embodiments of the invention, a space $a_1$ (between first thread 1245 and second thread 1250) may be greater than a space $a_2$ (between second thread 1250 and third thread 1255).

Consistent with embodiments on the invention, stock 1235 may be placed in compressor 1215. Once compressor 1215 receives stock 1235 into chamber 1230, plunger 1225 may compress stock 1235 and force (e.g., extrude) stock 1235 out the bottom end of chamber 1230. For example, while plunger 1225 is compressing stock 1235, plunger 1225 may also rotate within chamber 1230 thus mixing stock 1235 and generating frictional heat. The generated frictional heat may heat stock 1235 to a "plastic zone" of the stock.

The plastic zone may comprise a solid state in which stock 1235 is malleable, but not hot enough to be in a liquid or molten state. In other words, plastic zone extrusion system 1200 may rotate plunger 1225 to generate heat by rotating, mixing, and compressing stock 1235 within plastic zone extrusion system 1200. Once the generated heat places stock 1235 in the stock's plastic zone, the stock may be extruded out the bottom end of chamber 1230. The process may be continuously repeated by intermittently feeding more stock into compressor 1215. For example, plunger 1225 may be removed, more stock may be placed in chamber 1230, and plunger 1225 may be replaced in chamber 1230.

Once stock 1235, now in its plastic zone, leaves the bottom end of chamber 1230, it enters a space between screw 1210 and base 1205. Screw 1210 may be rotating in a direction that may force stock 1235 away from the bottom end of chamber 1230 and towards die 1220. Because the space between screw 1210 and base 1205 may gradually decrease in size from compressor 1215 to die 1220 (e.g. because $a_1>a_2$), the movement of screw 1210 may also compress (e.g. compact) and mix stock 1235.

Furthermore, because the space between screw 1210 and base 1205 may gradually decrease in size from compressor 1215 to die 1220 (e.g. because $a_1>a_2$), there may be more volume in the space at the end closest to compressor 1215 than at the end closest to die 1220. Consequently, the end of the space closest to compressor 1215 may act as a reservoir for stock 1235 allowing time for intermittently feeding more stock into compressor 1215 (e.g. continuously repeated by, for example, removing plunger 1225, placing more stock in chamber, and replacing plunger in chamber 1230.)

Consistent with other embodiments of the invention, compressor 1215 may be optional and the conveyer may be configured to generate frictional heat in stock 1235 to place stock 1235 in the plastic zone of stock 1235. Moreover, plastic zone may be achieved by die 1220, for example, by die 1220 rotating.

Figure 13:
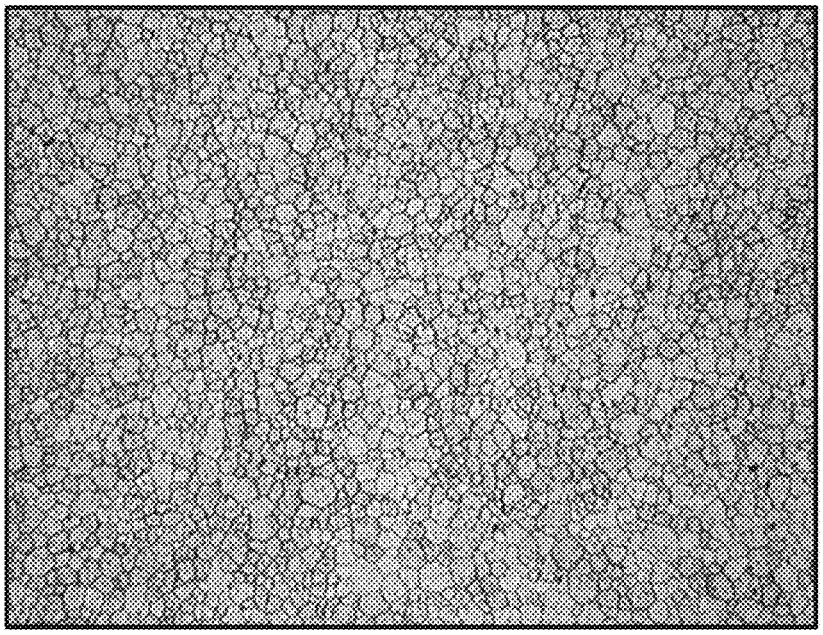
FIG. 13 shows a cross-section of wire produced by the plastic zone extrusion system.

FIG. 13 shows a cross-section of wire produced by the plastic zone extrusion system (e.g. system 1100 or system 1200) consistent with embodiments of the invention. The mosaic of microstructures shown in FIG. 13 illustrate that various elements comprising stock 1135 or stock 1235 may be substantially homogeneously distributed within wire 1140 and wire 1240 respectively. These various elements may comprise, but are not limited to, a single type of metal (or alloy), different types of metals (or metal alloys), and nanoparticles placed in stock 1135 or stock 1235. Because the stock (e.g. stock 1135 or stock 1235) was taken to its plastic zone and not melted, adhesion between the microstructures shown in FIG. 13 may be high. If the nanoparticles or alloys were heated to their liquid or molten state, the materials comprising nanoparticles or alloys would stratify into respective layers comprising the nanoparticles or alloys and would not be homogeneously distributed.

Figure 14:
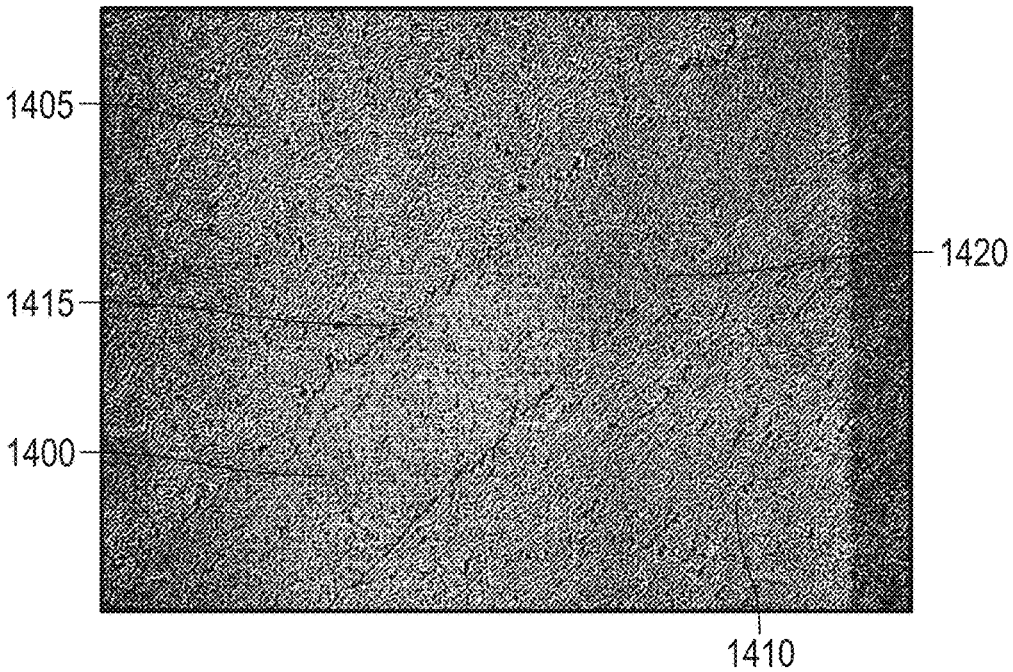
FIG. 14 shows a cross-section of wire produced by the plastic zone extrusion system.

Consistent with embodiments of the invention, stock comprising different metals alloys (e.g. a first alloy and a second alloy) may be placed in system 1100 or system 1200. Consequently, embodiments of the invention may produce wire (e.g. wire 1140 and wire 1240) that may include layered micro structures as illustrated in FIG. 14. As shown in FIG. 14, the wire may include a first microstructure 1400, a second microstructure 1405, and a third microstructure 1410. First microstructure 1400 may comprise the first alloy and second microstructure 1405 and third microstructure 1410 may comprise the second alloy.

Because the stock (e.g. stock 1135 or stock 1235) was taken to its plastic zone and not melted, adhesion between first microstructure 1400 (e.g. along a first edge 1415) and second microstructure 1405 and between first microstructure 1400 and third microstructure 1410 (e.g. along a second edge 1420) may be high. If the alloys were heated to their liquid or molten state, the materials comprising the alloys would stratify and would not result in the structures shown in FIG. 14.

Figure 15:
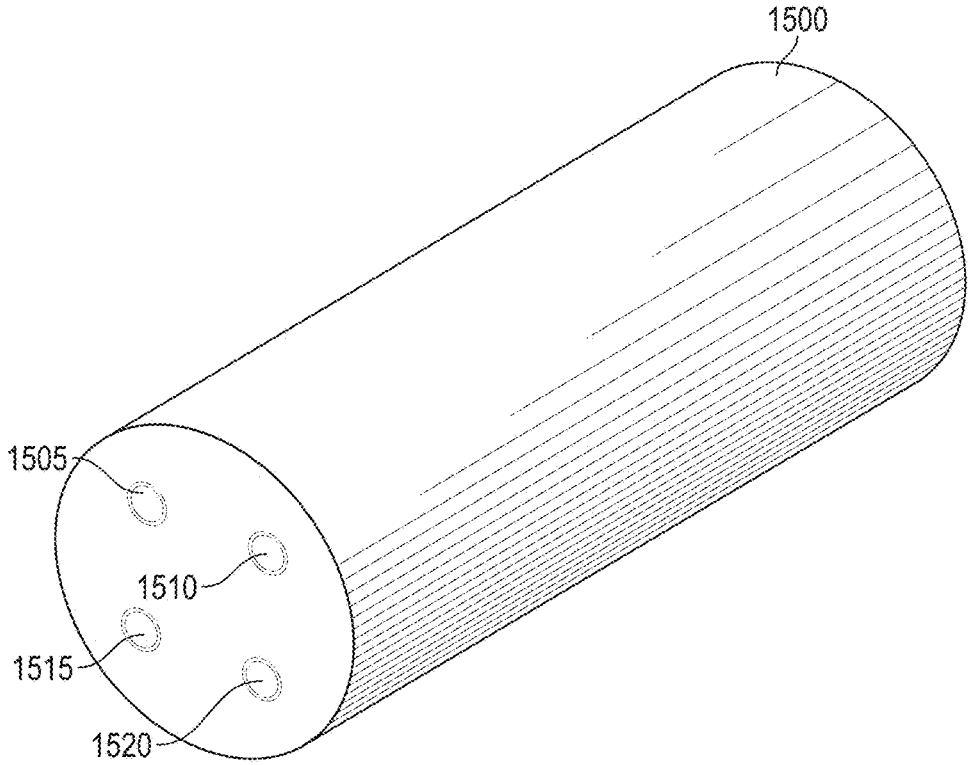
FIG. 15 shows a slug.

As stated above, the stock used to produce the layered micro structures as illustrated in FIG. 14 may include different metals alloys (e.g. the first alloy and the second alloy.) This stock may comprise chips of the different alloys placed into the system. As an alternative or in addition, the stock may include one or more slugs as shown in FIG. 15. As shown in FIG. 15, a slug 1500 may comprise the first alloy. Bores may be placed in slug 1500 and then filled with the second alloy. These filled bores may comprise a first filled bore 1505, a second filled bore 1510, a third filled bore 1515, and a forth filled bore 1520.

The ratios of the different metal alloys to the total amount of stock may be chosen to give the wire certain desired characteristics. For example, the first alloy may have a high thermal expansion and the second alloy may have a low thermal expansion. The amount of the first alloy and the second alloy may be chosen to give the wire a desired thermal expansion between that of the two alloys.

While certain embodiments of the invention have been described, other embodiments may exist. Further, the disclosed methods' stages may be modified in any manner, including by reordering stages and/or inserting or deleting stages, without departing from the invention. While the specification includes examples, the invention's scope is indicated by the following claims. Furthermore, while the specification has been described in language specific to structural features and/or methodological acts, the claims are not limited to the features or acts described above. Rather, the specific features and acts described above are disclosed as example for embodiments of the invention.

What is claimed is:

1. A system comprising:
a compressor configured to receive a stock;
a conveyer configured to receive the stock from the compressor and transport the stock from the compressor wherein the conveyer comprises;
a base; and
a screw configured to rotate in the base to transport the stock from the compressor to a die, wherein the screw comprises,
a first thread,
a second thread, and
a third thread, the first thread being closer to the compressor than the second thread and the third thread, the third thread being closer to the die than the first thread and the second thread, the second thread being between the first thread and the third thread, a space between the first thread and the second thread being greater than a space between the second thread and the third thread; and
the die configured to;
receive the stock from the conveyer, and
extrude the stock to form a wire.

2. The system of claim 1, wherein the compressor comprises a chamber and a plunger.

3. The system of claim 2, wherein the plunger is configured to rotate in the chamber.

4. The system of claim 1, wherein the conveyer being configured to transport the stock from the compressor comprises the conveyer being configured to mix the stock.

5. The system of claim 1, wherein the stock comprises at least two of the following: a first alloy, a second alloy, first nano-particles, and second nano-particles.

6. The system of claim 1, wherein the compressor is configured to generate frictional heat in the stock to place the stock in a plastic zone of the stock.

7. The system of claim 1, wherein the conveyer is configured to generate frictional heat in the stock to place the stock in a plastic zone of the stock.

8. The system of claim 1, wherein the die is configured to generate frictional heat in the stock to place the stock in a plastic zone of the stock.

9. The system of claim 1, wherein:
the stock comprises at least a first alloy and a second alloy; and
the wire comprises a first microstructure and second microstructure having a high adhesion between the first microstructure and second microstructure.

10. The system of claim 1, wherein:
the stock comprises a metal and nanoparticles; and
the wire comprises microstructures of the metal and of the nanoparticles distributed substantially homogeneously within the wire.

* * * * *